US008811856B2

(12) United States Patent
Okabe

(10) Patent No.: US 8,811,856 B2
(45) Date of Patent: Aug. 19, 2014

(54) IMAGE FORMING DEVICE HAVING PROCESS UNIT WITH IMPROVED HANDGRIPS

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 122 days.

(21) Appl. No.: 13/423,469

(22) Filed: Mar. 19, 2012

(65) Prior Publication Data

US 2012/0269541 A1 Oct. 25, 2012

(30) Foreign Application Priority Data

Apr. 22, 2011 (JP) ..... 2011-096553

(51) Int. Cl.
*G03G 15/00* (2006.01)

(52) U.S. Cl.
USPC ..... 399/110; 399/111

(58) Field of Classification Search
USPC ..... 399/92, 110, 111, 113, 299
See application file for complete search history.

(56) References Cited

U.S. PATENT DOCUMENTS

| | | | |
|---|---|---|---|
| 5,204,713 | A | 4/1993 | Yamamura |
| 7,426,355 | B2 | 9/2008 | Okabe |
| 7,778,567 | B2 | 8/2010 | Igarashi et al. |
| 7,912,406 | B2 | 3/2011 | Okabe |
| 8,050,589 | B2 | 11/2011 | Okabe |
| 8,340,549 | B2 | 12/2012 | Igarashi et al. |
| 8,358,952 | B2 | 1/2013 | Okabe |
| 2006/0067734 | A1 | 3/2006 | Igarashi et al. |
| 2007/0036581 | A1 | 2/2007 | Okabe |
| 2007/0122176 | A1 | 5/2007 | Sato |
| 2007/0147888 | A1 | 6/2007 | Igarashi et al. |
| 2009/0190955 | A1 | 7/2009 | Igarashi et al. |
| 2009/0324275 | A1 | 12/2009 | Okabe |
| 2010/0135696 | A1 | 6/2010 | Okabe |
| 2010/0183329 | A1 | 7/2010 | Okabe |
| 2012/0057900 | A1 | 3/2012 | Okabe |
| 2013/0084101 | A1 | 4/2013 | Igarashi et al. |

FOREIGN PATENT DOCUMENTS

| | | | |
|---|---|---|---|
| CN | 1755555 | A | 4/2006 |
| EP | 2138908 | A1 | 12/2009 |
| JP | 2006-098772 | | 4/2006 |
| JP | 2007-072421 | | 3/2007 |
| JP | 2010-026541 | | 2/2010 |
| JP | 2010-096794 | A | 4/2010 |
| JP | 2010-122554 | A | 6/2010 |

OTHER PUBLICATIONS

Office Action issued in corresponding Chinese Patent Application No. 201210086667.9, mailed Sep. 4, 2013.
European Search Report issued in corresponding European Patent Application No. 12159914.6, dated May 21, 2014.

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming device may include a process unit including: cartridges arrayed side by side in an array direction; and a support unit supporting the cartridges and movable in the array direction between an accommodated position where the support unit is accommodated in a main casing and a pulled out position, away from the accommodated position, for detachment and attachment of the support unit. The support unit includes: a frame; a first handgrip including a leg portion having a portion connected to the frame, and a grip portion connected to the leg portion and positioned downstream of a most upstream end of a most upstream side cartridge in a pulling out direction along the array direction for pulling out the support unit when the support unit is at the accommodated position; and a second hand grip positioned downstream of the first hand grip in the pulling out direction.

18 Claims, 9 Drawing Sheets

IMAGE FORMING DEVICE HAVING PROCESS UNIT WITH IMPROVED HANDGRIPS

CROSS REFERENCE TO RELATED APPLICATION

This application claims priority from Japanese Patent Application No. 2011-096553 filed Apr. 22, 2011. The entire content of the priority application is incorporated herein by reference.

TECHNICAL FIELD

The present invention relates to an electro-photographic type image forming device, and more specifically to such image forming device having a process unit with improved handgrips.

BACKGROUND

Japanese Patent Application Publication No. 2010-26541 discloses a color laser printer as an electro-photographic type image forming device including a plurality of photosensitive drums on which electrostatic latent image is formable, and a plurality of developing rollers each in pressure contact with each photosensitive drum and adapted to supply each color of toner to each photosensitive drum. Further, the plurality of photosensitive drums is integrally supported at a drum unit that is detachably attached to a main casing of the color printer. A plurality of developing cartridges including the plurality of plurality of developing rollers, respectively, is detachably attached to the drum unit.

The drum unit has a front end portion provided with a near side hand grip portion, and a rear end portion provided with a back side hand grip portion. The drum unit is movable frontward from an accommodation space in the main casing to a pulled-out position where the back side hand grip portion becomes accessible for a user, and then the drum unit is removed from the main casing.

SUMMARY

According to the conventional color laser printer described in the above-described Japanese publication, for taking out the drum unit from the main casing, the drum unit in its entirety must be pulled out of the main casing so as to permit the back side hand grip portion to be accessible for the user. In this connection, the present inventor found that a center of gravity of the laser printer may be displaced frontward when the drum unit is largely pulled out frontward. This may lead to frontward falling of the printer as a result of imbalance.

It is therefore an object of the present invention to provide an image forming device capable of avoiding frontward falling of the device even when a unit holding a plurality of photosensitive drums is pulled out frontward for detachment of the unit from a main casing of the image forming device.

In order to attain the above and other objects, the invention provides an image forming device includes: a main casing; and a process unit including: a plurality of cartridges arrayed side by side with a space between neighboring cartridges and defining an array direction, each cartridge accommodating therein a developing agent; and a support unit supporting the plurality of cartridges and movable in the array direction relative to the main casing between an accommodated position where the support unit is accommodated in the main casing and a pulled out position where the support unit is moved away from the accommodated position for detachment and attachment of the support unit from and to the main casing. The support unit includes: a frame; a first handgrip including a leg portion having a connected portion connected to the frame, and a grip portion connected to the leg portion and positioned downstream of a most upstream end of a most upstream side cartridge in a pulling out direction along the array direction for pulling out the support unit in a state where the support unit is at the accommodated position; and a second hand grip positioned downstream of the first hand grip in the pulling out direction.

BRIEF DESCRIPTION OF THE DRAWINGS

In the drawings;

FIG. 6(*b*) is a schematic cross-sectional view for description of hand-gripping the process unit in the color printer according to the third embodiment;

DETAILED DESCRIPTION

Figure 1:
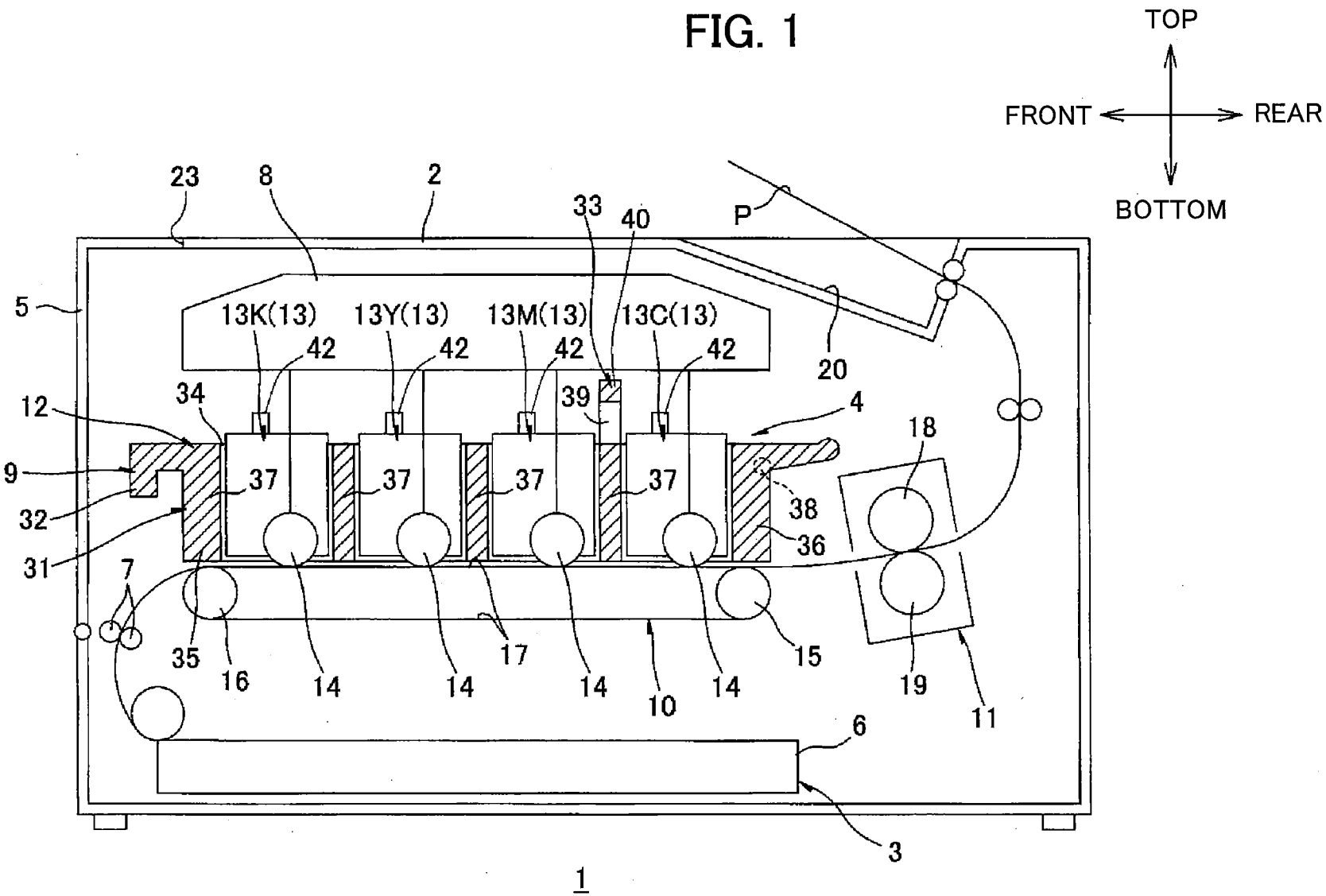
FIG. 1 is a schematic cross-sectional side view of a color printer according to a first embodiment of the present invention.

A color printer as an image forming device according to a first embodiment of the present invention will be described with reference to FIGS. 1 through 4.

1. Overall Structure of Color Laser Printer

The color printer 1 is a transverse-mounted tandem type printer and includes a main casing 2 in which a sheet feed unit 3 for feeding a sheet P, and an image forming unit 4 for forming an image on the sheet P fed by the sheet feed unit 3 are provided.

(1) Main Casing

The main casing 2 is box-shaped and has a rectangular shape in side view. An opening 23 is formed at a front side of the main casing 2.

Throughout the specification, the terms "upward", "downward", "upper", "lower", "above", "below", "beneath", "right", "left", "front", "rear" and the like will be used assuming that the color printer is disposed in an orientation in which it is intended to be used. More specifically, in FIG. 1 a left side at which the opening 23 is formed is a front side and the right side is a rear side, respectively.

The opening 23 is formed between a front end and an upper front portion of the main casing 2. The upper front portion of the opening 23 has a frontward/rearward length greater than that of a process cartridge 13 (described later) as shown in FIG. 2.

A front cover 5 is provided at the front end portion of the main casing 2 so as to open and close the opening 23. That is, the front cover 5 is generally L-shaped having a first portion for closing and opening the front opening part and having a second portion extending from an upper end of the first portion for closing and opening an upper front opening part. The first portion has a lower end portion pivotally connected to the main casing 2. Thus, the front cover 5 is pivotally movable between an open position shown in FIG. 2 and a closed position shown in FIG. 1.

Figure 2:
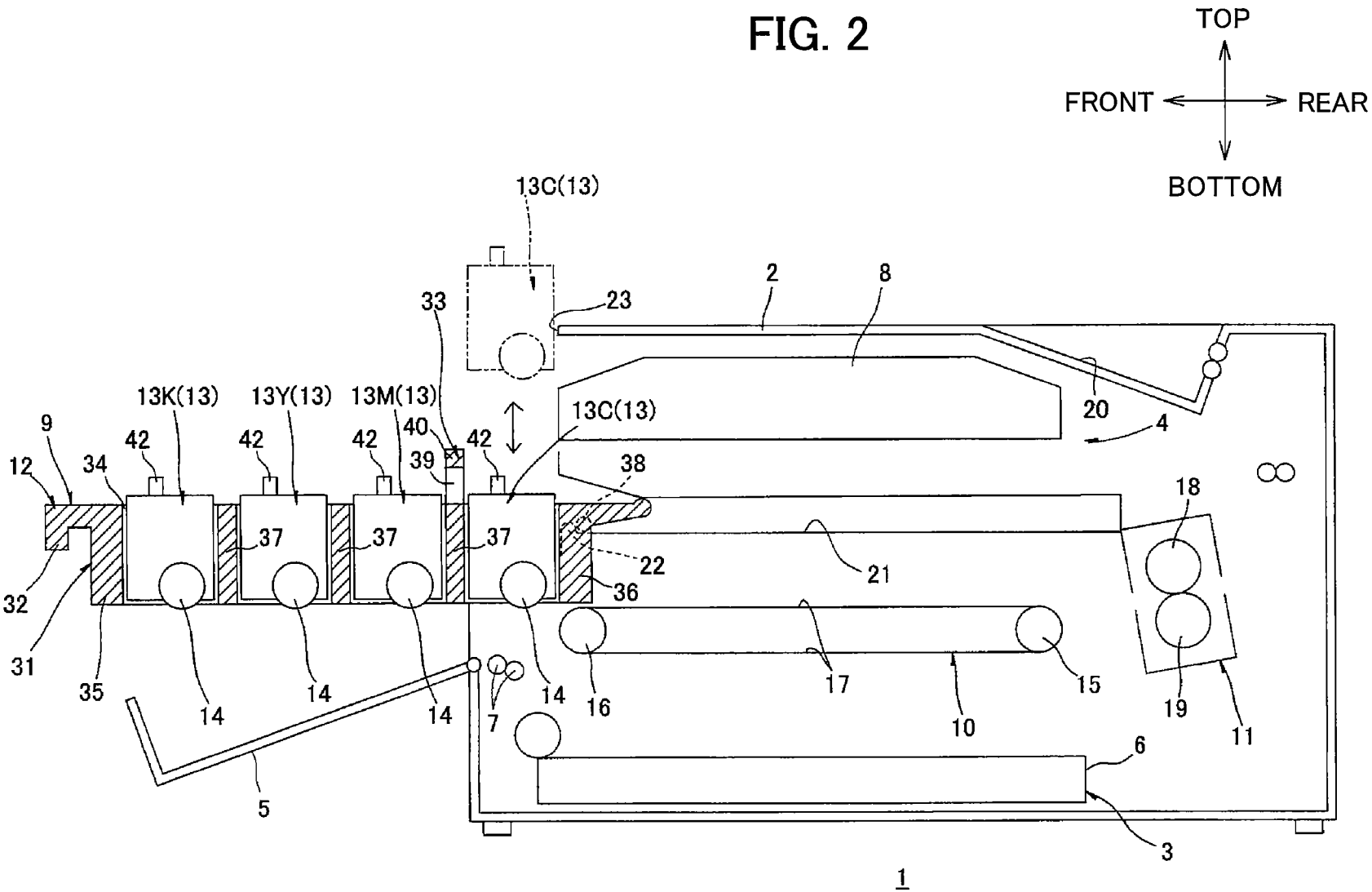
FIG. 2 is a view showing a state where a process unit is moved to a pulled out position from a main frame of the color printer according to the embodiment.

Further, the main casing 2 has left and right side walls whose substantially vertically center portion is formed with a guide groove 21 extending in frontward/rearward direction as shown in FIG. 2. Each guide groove 21 is formed in an inner surface of each side wall and recessed laterally outward. The guide groove 12 has a front end positioned rearward of the upper front opening portion of the opening 23. A stopper 22 having a generally semicircular shape in side view protrudes upward from a front end portion of a lower surface toward an upper surface of the guide groove 21.

(2) Sheet Feed Unit

The sheet feed unit 3 includes a sheet tray 6 for accommodating a stack of sheets P. A pair of registration rollers 7 is positioned above an upper end portion of the sheet tray 6. Each sheet P is conveyed from the sheet tray 6 to a portion between the pair of registration rollers 7, and is conveyed to the image forming unit 4 at a predetermined timing, i.e., conveyed to a portion between a photosensitive drum 14 and a conveyer belt 17 described later.

(3) Image Forming Unit

The image forming unit 4 includes a scanner unit 8 (exposure unit), a process unit 9, a transfer unit 10, and a fixing unit 11.

(3-1) Scanner Unit

The scanner unit 8 is provided at an upper portion in the main casing 2 and is positioned rearward of the upper front opening part of the opening 23. The scanner unit 8 is adapted to expose four photosensitive drums 14 to laser beams based on image data as shown by solid lines.

(3-2) Process Unit (3-2-1) Construction of Process Unit

The process unit 9 is positioned below the scanner unit 8 and above the sheet tray 6, and includes a drawer unit 12 and four process cartridges 13 each corresponding to each color.

The drawer unit 12 (support unit) is slidably movable in frontward/rearward direction between an accommodated position at which the drawer unit 12 is accommodated in the main casing 2 as shown in FIG. 1 and a pulled out position at which the drawer unit 12 is pulled out of the main casing 2 but still engaged with the main casing 2 as shown in FIG. 2. The drawer unit 12 can be detached from and attached to the main casing 2 at the pulled out position.

The process cartridges 13 are detachably attached to the drawer unit 12 and are arrayed in frontward/rearward direction in the attached state. More specifically, a black process cartridge 13K, an yellow process cartridge 13Y, a magenta process cartridge 13M and cyan process cartridge 13C are arrayed in this order from front side to rear side. A handle 42 extends upward from each upper end portion of each process cartridge 13, so that a user can hold the handle 42 for attachment and detachment of each process cartridge 13.

Each process cartridge 13 includes the photosensitive drum 14 having a cylindrical shape extending in lateral direction. Each photosensitive drum 14 is rotatably supported to a lower end portion of each cartridge casing of the process cartridge 13 such that a lower portion of the photosensitive drum 14 is exposed to an outside of the cartridge 13.

Further, a developing roller (not shown) carrying toner is rotatably supported to the cartridge casing of the process cartridge 13 such that the developing roller is positioned diagonally upward and frontward of and in contact with the photosensitive drum 14. A scorotron charger (not shown) positioned directly above the photosensitive drum 14 is provided in the process cartridge 13, and a toner casing is also provided in the process cartridge 13.

(3-2-2) Developing Operation

An outer peripheral surface of the developing roller is supplied with toner in accordance with the rotation of the developing roller.

In the image forming unit 4, each surface of each photosensitive drum 14 is uniformly charged by the charger in accordance with the rotation of the photosensitive drum 14, and then, is exposed to laser beam by high speed scanning at the scanner unit 8, so that an electrostatic latent image based on image data is formed on the surface of the photosensitive drum 14. Then, toner in the toner container is supplied to the photosensitive drum by the developing roller 53 to form a toner image on the surface of the photosensitive drum 51.

Then toner carried on the developing roller is supplied to the surface of the photosensitive drum 14 in accordance with further rotation thereof, so that the electrostatic latent image becomes a visible toner image on the surface of the photosensitive drum 14 as a result of reversal development.

(3-3) Transfer Unit

The transfer unit 10 is positioned below the process unit 9 and above the sheet supply unit 3, and extends in frontward/rearward direction. The transfer unit 10 includes a drive roller 15, a driven roller 16, and the conveyer belt 17.

The drive roller 15 and the driven roller 16 are spaced away from each other in the frontward/rearward direction and extend in a direction parallel to each other.

The conveyer belt 17 is mounted under tension between the drive and driven rollers 15 and 16 such that an upper portion of the conveyer belt 17 is in contact with each photosensitive drum 14. By the rotation of the drive roller 15, the conveyer belt 17 is circularly moved such that the upper portion of the conveyer belt 17 is moved rearward.

The sheet P supplied from the sheet supply unit 3 is conveyed on the conveyer belt 17 rearward and is moved past each transfer position defined by each photosensitive drum 14 and the conveyer belt 17, whereupon each color toner image on each photosensitive drum 14 is successively transferred onto a sheet P to form a color image on the sheet P.

(3-4) Fixing Unit

The fixing unit 11 is positioned rearward of the process unit 9, and includes a heat roller 18 and a pressure roller 19 in confrontation with the heat roller 18 for pressing the same.

The toner image on the sheet P is thermally and pressurizingly fixed when the sheet P passes through and between the heat roller 18 and the pressure roller 19.

(4) Paper Discharge

A discharge tray 20 is defined at an upper surface of the main casing 2. The sheet P with the fixed image is discharged onto the discharge tray 20.

2. Details of Process Unit (1) Drawer Unit

Figure 3:
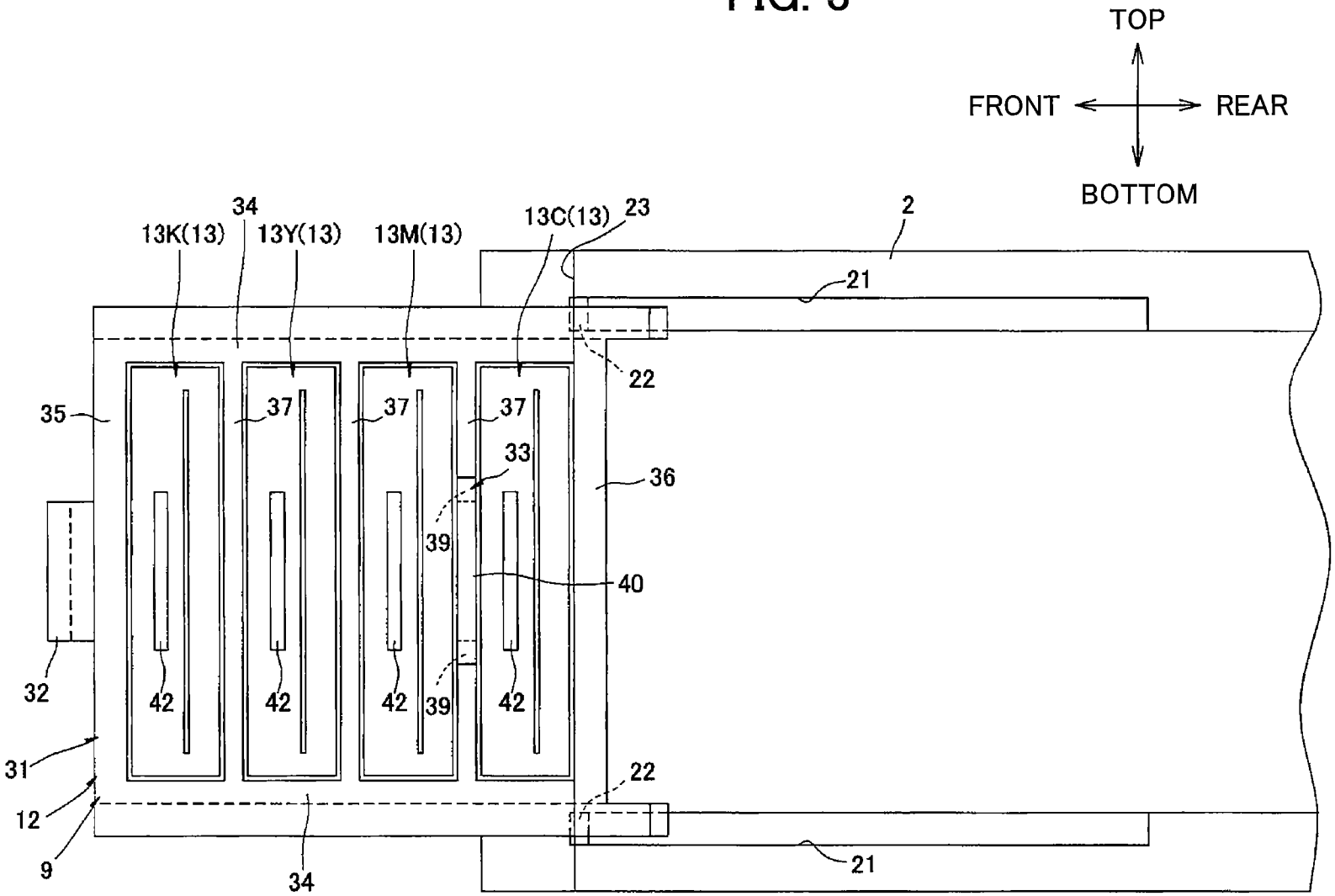
FIG. 3 is a plan view of the process unit in a state where the process unit is at the pulled out position in the color printer according to the embodiment.

As shown in FIGS. 2 and 3, the drawer unit 12 includes a drawer frame 31 (frame) for supporting respective process cartridges 13, a back side hand grip 33 (first hand grip) for lifting a rear portion of the drawer frame 31, and a near side hand grip 32 (second hand grip) for lifting a front portion of the drawer frame 31.

The drawer frame 31 is generally rectangular shaped including a pair of side walls 34, a front wall 35, a rear wall 36, and three partitioning walls 37.

The pair of side walls 34 are generally rectangular plate shaped elongated in the frontward/rearward direction, and are spaced away from each other in the lateral direction for positioning each process cartridge 13 therebetween. Each side wall 34 has a rear end portion rotatably provided with a roller 38 at a position rearward of the rearmost process cartridge 13C. Each roller 38 is rollingly movable on each guide groove 21. Further, the roller 38 is abutable on the stopper 22 when the process unit 9 is moved to the pulled-out position.

The front wall 35 is generally plate shaped and is spanned between front end portions of the side walls 34. The rear wall 36 is generally plate shaped and is spanned between rear end portions of the side walls 34.

Each partitioning wall 37 is generally plate shaped and arrayed with a constant gap in the frontward/rearward direction between the front wall 35 and the rear wall 36, and is positioned between the side walls 34. In other words, a space defined by the front wall 35, the rear wall 36, and the pair of side walls 34 is equally divided into four spaces arrayed in the frontward/rearward direction by the three partitioning walls 37. Each process cartridge 13 can be positioned in each divided space.

The near side handgrip 32 is integrally with the front wall 35 and is generally L-shaped in side view. Specifically, the near side handgrip 32 is positioned at laterally center portion of the front wall 35 and has a base portion protruding frontward from an upper front surface of the front wall 35 and a free end portion bent downward from a front end of the base portion.

The back side handgrip 33 is positioned at laterally center portion of the rearmost partitioning wall 37, and extends upward from an upper surface of the rearmost partitioning wall 37, and is integral therewith. That is, the back side handgrip 33 is integral with the partitioning wall 37 and positioned frontward of the rearmost process cartridge 13C.

The back side handgrip 33 is inverted U-shaped in front view, and includes a pair of right and left legs 39 and a grip portion 40 integral therewith.

The legs 39 are in the form of prismatic beams extending upward from the upper surface of the rearmost partitioning wall 37. More specifically, the base end portions (connected portions) of the legs 39 are connected to the upper surface of the rearmost partitioning wall 37.

The grip portion 40 is spanned in the lateral direction between upper end portions of the legs 39, and is in the form of prismatic body. The grip portion 40 is positioned higher than the handle 42 of the process cartridge 13.

(2) Attachment/Detachment of Process Cartridge

For replacing a used process cartridge 13 with a new process cartridge 13, as shown in FIG. 2, a user opens the front cover 5 to grip the near side handgrip 32 of the drawer unit 12, and then, the user pulls the process unit 9 frontward until the roller 38 is brought into abutment with the stopper 22. Thus, the process unit 9 is at the pulled-out position.

In this case, each process cartridge 13 is positioned frontward of an upper wall of the main casing 2 as shown in FIG. 3. In other words, the cyan process cartridge 13C is positioned in superposed relation to the upper front opening part of the opening 23 in plane view.

Then, the used process cartridge 13 is removed upward from the drawer unit 12, and a new process cartridge 13 is attached to the drawer unit 13 from above. The cyan process cartridge 13C can be moved past the upper front opening part of the opening 23 during vertical movement of the cartridge 13C.

Then, the process unit 9 is again accommodated in the main casing 2, and the front cover 5 is closed. Thus, exchanging work of the process cartridge relative to the main casing 2 is completed.

(3) Attachment/Detachment of Process Unit

The process unit 9 must be removed from the main casing 2 so as to cope with a sheet jamming occurring between the conveyer belt 17 and a photosensitive drum 14. First, the process unit 9 is moved to the pulled-out position as described above and as shown in FIG. 2.

In this case, the back side handgrip 33 is positioned frontward of a rear edge of the front upper opening part of the opening 23. That is, the grip portion 40 of the back side handgrip 33 is exposed to an outside of the main casing 2.

Then, one hand and another hand grip the near side handgrip 32 and the grip portion 40 of the back side handgrip 33, respectively, and the user lifts the near side handgrip 32 upward such that the process unit 9 is pivotally moved about the rear end portion thereof.

Then, the process unit 9 can be detached from the main casing 2 after the roller 38 is moved frontward past the stopper 22.

Figure 4:
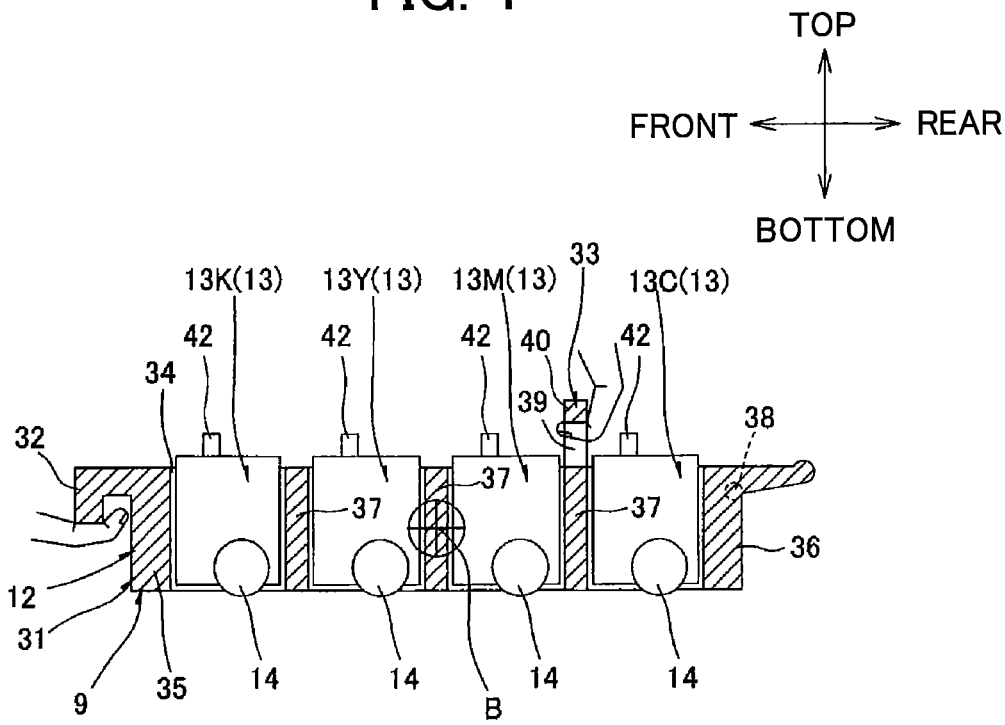
FIG. 4 is a schematic cross-sectional view for description of hand-gripping the process unit in the color printer according to the embodiment.

As shown in FIG. 4, a center of gravity B of the process unit 9 that has been removed from the main casing 2 is positioned at generally intermediate portion of the process unit 9 in the frontward/rearward direction. That is, when the process unit 9 is just removed from the main casing 2, the grip portion 40 of the back side handgrip 33 is positioned rearward of the center of gravity B, while the near side handgrip 32 is positioned frontward thereof.

Then, the user can remove the jammed sheet exposed on the conveyer belt 17.

Thereafter, the user grips the near side handgrip 32 and back side hand grip 33 for inserting the rear end portion of the process unit 9 into the main casing 2 in order to fit the roller 38 with the guide groove 21 at a position rearward of the stopper 22.

Then, the user releases his hand from the back side handgrip 33, and pushes the process unit 9 rearward into the main casing 2, and then closes the front cover 5.

Thus, detachment/attachment work of the process unit relative to the main casing 2 is completed.

3. Effect (1) As described above, the rear end portion of the process unit 9 still remains in the main casing 2 when the process unit 9 is moved to the pulled-out position so as to access to the grip portion 40 of the back side handgrip 33. Therefore, imbalance of the printer 1 does not occur. Accordingly, frontward falling of the printer 1 can be avoided yet detachment of the process unit 9 from the main casing 2 is attainable.

(2) Further, as shown in FIG. 4, the base end portions of the legs 39 of the back side handgrip 33 are fixed to or integral with the side walls 34, and the center of gravity B is positioned between the near side handgrip 32 and the grip portion 40 of the back side hand grip 33. Therefore, the process unit 9 can be held stably at front side and rear side of the center of gravity B.

4. Second Embodiment

Figure 5:
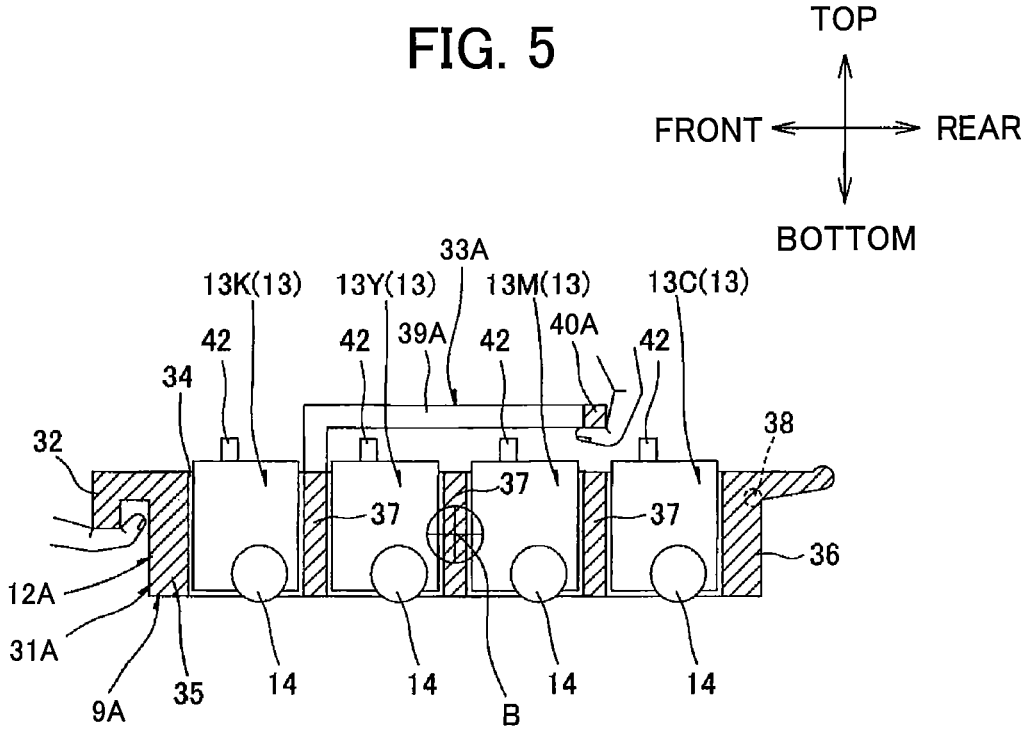
FIG. 5 is a schematic cross-sectional view for description of hand-gripping a process unit in a color printer according to a second embodiment of the present invention.

A color laser printer according to a second embodiment of the present invention will be described with reference to FIG. 5. The second embodiment and the following third to seventh embodiments pertain to a modification to a process unit. In the following embodiments, like parts and components are designated by the same reference numerals as those shown in in FIGS. 1 through 4.

In the second embodiment, a process unit 9A has a drawer unit 12A including a drawer frame 31B and a back side handgrip 33A including an L-shaped legs 39A and a grip portion 40A those integrally formed with a frontmost partitioning wall 37.

Each L-shaped legs 39A has a base portion extending upward from the frontmost partitioning wall 37, and an extension portion extending rearward from an upper end portion of the base portion to a position corresponding to a rearmost partitioning wall 37. The grip portion 40A is spanned between rear end portions of the extension portion.

With this structure, the grip portion 40A is positioned rearward of the center of gravity B, and the near side handgrip 32 is positioned frontward of the center of gravity B.

5. Third Embodiment

Figure 6A:
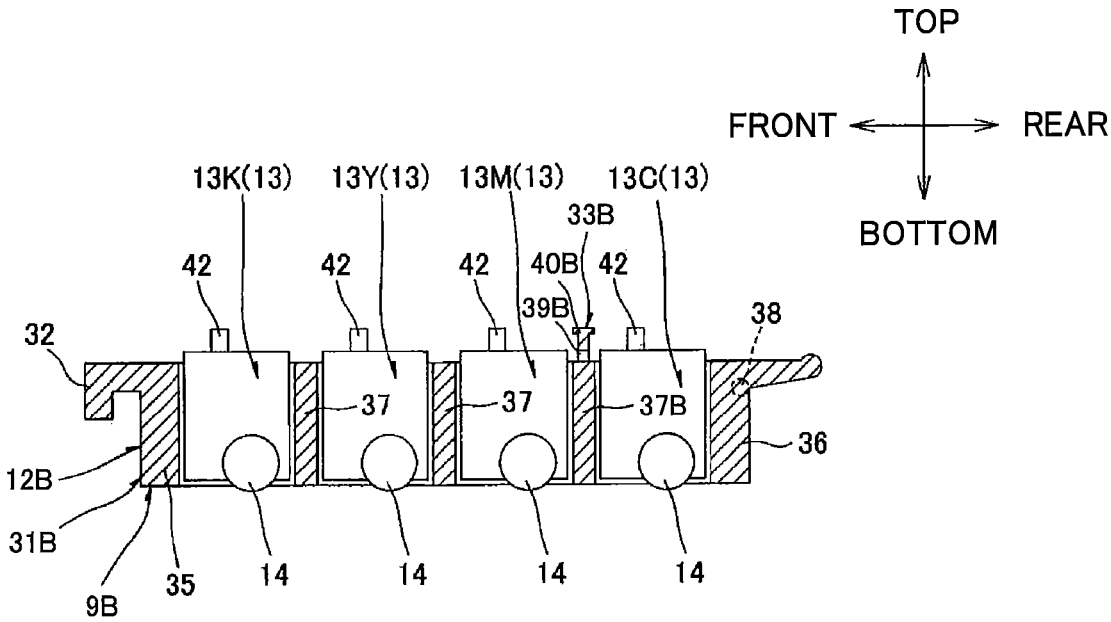
FIG. 6(*a*) is a schematic cross-sectional view of a process unit and showing a state where the process unit is moved to its pulled-out position in a color printer according to a third embodiment of the present invention.
Figure 6B:
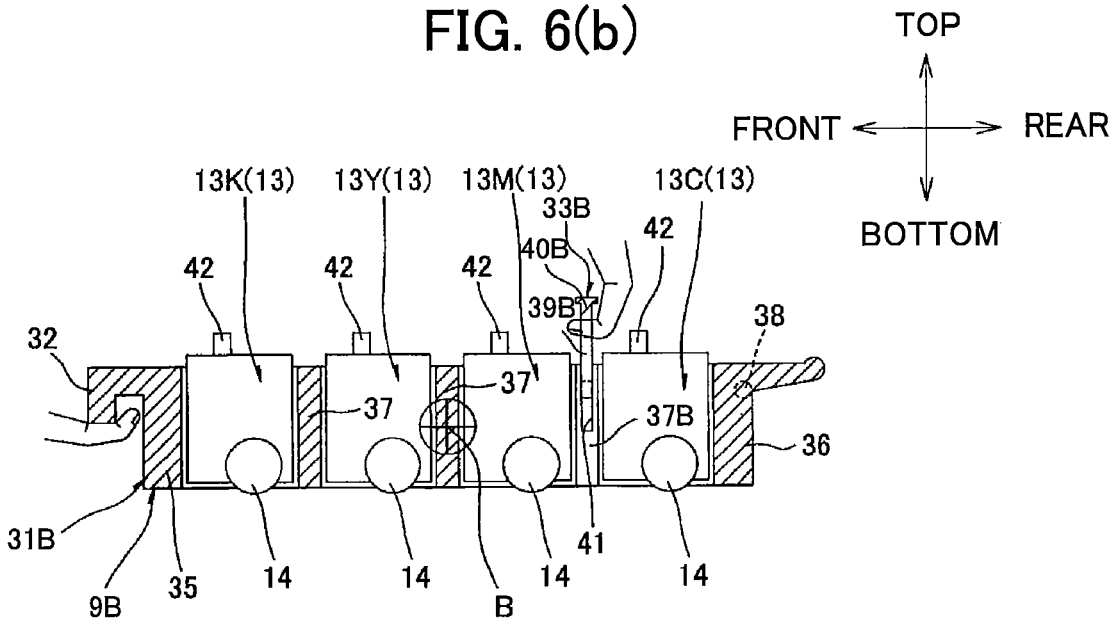

A third embodiment is shown in FIG. 6. A process unit 9B has a drawer unit 12B including a drawer frame 31B in which a back side handgrip 33B is vertically movable such that the handgrip 33B is protrudable from and retractable into a rearmost partitioning wall 37B.

More specifically, the rearmost partitioning wall 37B is formed with a hole 41 for accommodating therein the back side handgrip 33B at a laterally intermediate position thereof. The back side handgrip 33B is movable within the hole 41 to one of a protruding position (FIG. 6(*b*)) and a retracted position (FIG. 6(*a*)).

The hole 41 has lateral side surfaces (a right side surface and a left side surface) formed into hook shape engageable with upper end portions of lateral side surfaces of the back side hand grip 33B so as to prevent the back side handgrip 33B from further moving upward to avoid separation of the back side handgrip 33B from the rearmost partitioning wall 37B.

In the retracted position of the back side handgrip 33B, an upper portion of the handgrip 33B slightly protrudes upward from the hole 41 so that an upper end of the handgrip 33B is aligned with upper ends of the handles 42. On the other hand, in the protruding position, the handgrip 33B largely protrudes outward from the hole 41 to exceed the vertical level of the upper ends of the handles 41. Further, the grip portion 40B is positioned rearward of the center of gravity B, and the near side handgrip 32 is positioned frontward thereof.

The second and third embodiments can provide function and effect similar to those of the first embodiment. Further, in the third embodiment, compact accommodation of the process unit 9B into the main casing 2 can be attained because of the retraction of the back side handgrip 33B. For detaching the process unit 9B from the main casing 2, the back side handgrip 33B are pulled upward to its protruding position for facilitating access to the grip portion 40B.

6. Fourth Embodiment

Figure 7:
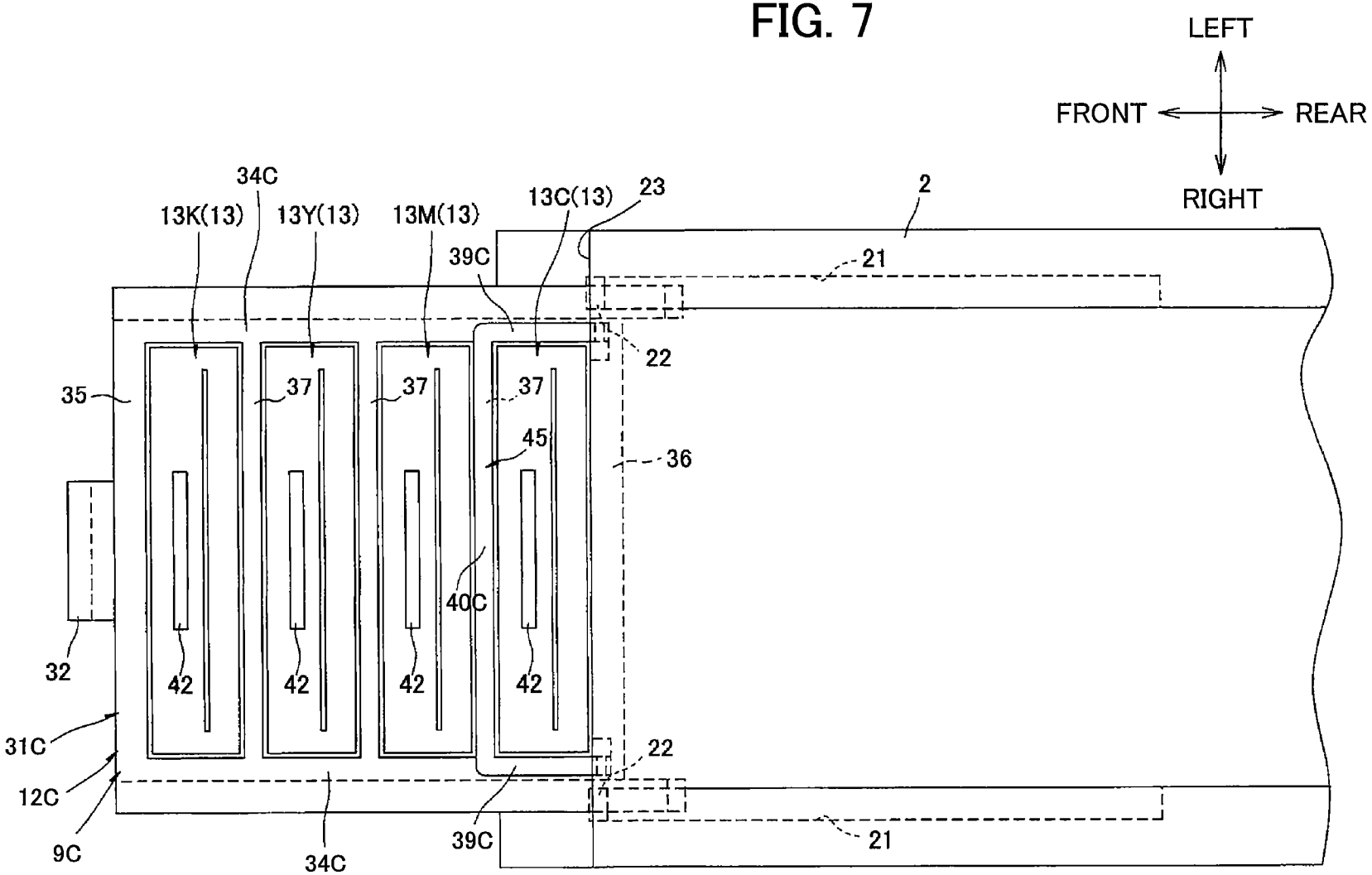
FIG. 7 is a plan view of a process unit in a state where the process unit is at the pulled out position in a color printer according to a fourth embodiment of the present invention.
Figure 8:
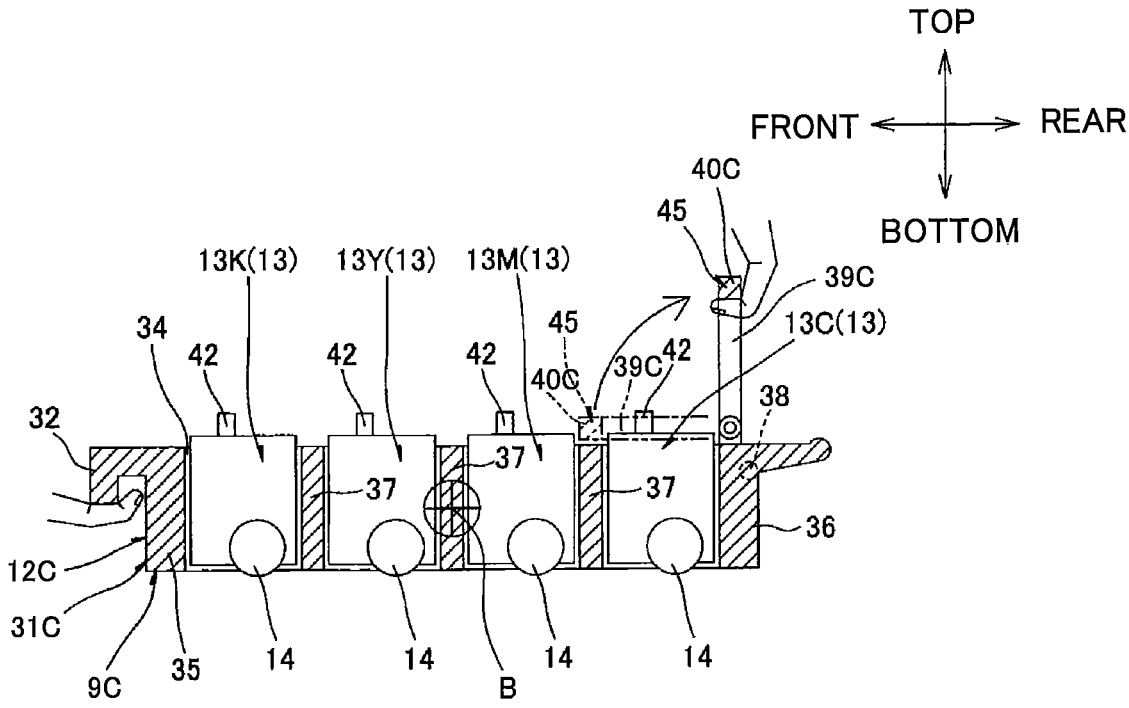
FIG. 8 is a schematic cross-sectional view for description of hand-gripping the process unit in the color printer according to the fourth embodiment.

A fourth embodiment is shown in FIGS. 7 and 8. A process unit 9C has a drawer unit 12C including a drawer frame 31C having a pair of side walls 34C. A back side handgrip 45 is not provided at the partitioning wall 37 but is provided at the side walls 34C. More specifically, the back side handgrip 45 has a generally U-shape configuration as shown in FIG. 7 and includes legs 39C and a grip portion 40C.

Each leg 39C has a lower or base end portion (connected portion) pivotally movably connected to a rear end portion of an upper surface of each side wall 34C. More specifically, the pivotally connected portion is located rearward of a rear end of the cyan process cartridge 13C. The grip portion 40C extends in lateral direction and is spanned between free end portions of the legs 39C.

The back side handgrip 45 has a rectangular cross-section, and is pivotally movable between an upstanding position where the legs 39C are oriented in vertical direction and a resting position where the legs 39C are oriented in frontward/rearward direction. In the upstanding position, an uppermost portion of the handgrip 45 is positioned higher than the handles 42. In the resting position, an uppermost portion of the handgrip 45 is positioned lower than the handle 42, and the grip portion 40C is positioned immediately above the rearmost partitioning wall 37, and each leg 39C is positioned immediately above an upper surface of each side wall 34.

With this structure, for accommodating the process unit 9C in the main casing 2, the back side handgrip 45 is pivotally moved to the resting position, and for detaching the process unit 9C the back side handgrip 45 is pivotally moved to its upstanding position to grip the grip portion 40C.

The fourth embodiment exhibits function and effect same as those of the first embodiment. Further, as shown in FIG. 8, each leg 39C is pivotally connected to each side wall 34C at a position rearward of the magenta process cartridge 13M positioned frontward of the rearmost cyan process cartridge 13C. Therefore, frontward tilting of the back side handgrip 45 can provide a compact process unit in vertical direction for accommodation of the process unit 9C in the main casing 2. The frontward tilting of the handgrip 45 can facilitate access to the grip portion 40C at the pulled-out position of the process unit 9C.

Further, the connected portion i.e., the base end portion of the leg 39C is positioned rearward of the center of gravity B, while the near side handgrip 32 is positioned frontward of the center of gravity B. Accordingly, the process unit 9C can be held or lifted stably at positions frontward of and rearward of the center of gravity B.

7. Fifth Embodiment

Figure 9:
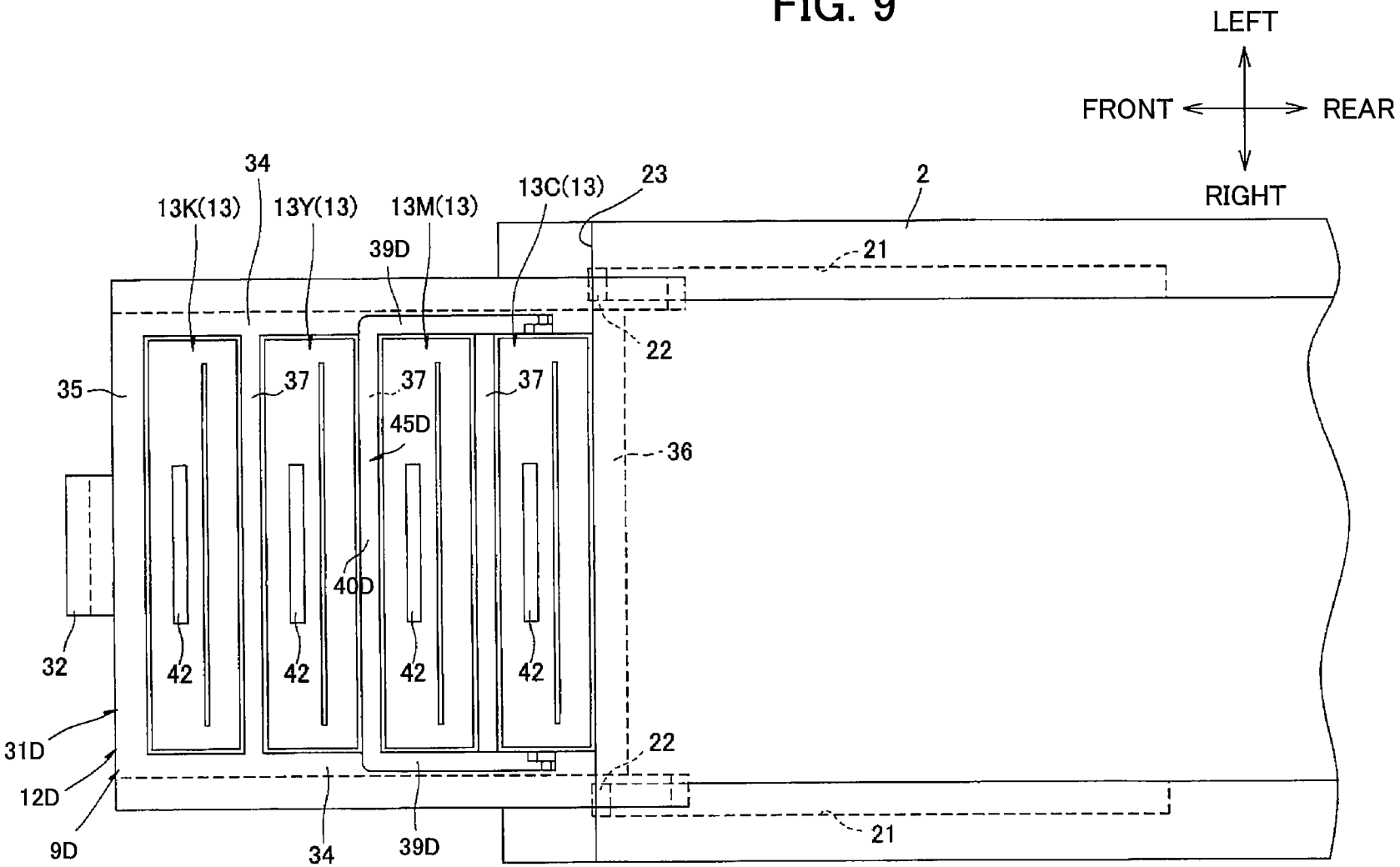
FIG. 9 is a plan view of a process unit in a state where the process unit is at the pulled out position in a color printer according to a fifth embodiment of the present invention.

A fifth embodiment is shown in FIG. 9. The fifth embodiment is a modification to the fourth embodiment. A process unit 9D has a drawer unit 12D including a drawer frame 31D having a pair of side walls 34D. Each base portion of each leg 39D of a back side handgrip 45D is pivotally connected to an upper surface of each side wall 34D and at a position laterally beside the cyan process cartridge 13C. Further, in the resting position of the handgrip 45D, the grip portion 40D is positioned immediately above an intermediate partitioning wall 37.

With this structure, the connected portion i.e., the base end portion of the leg 39D is positioned rearward of the center of gravity B, while the near side handgrip 32 is positioned frontward of the center of gravity B similar to the foregoing embodiments. Further, the grip portion 40D can be positioned immediately above the partitioning wall 37 other than the rearmost partitioning wall 37 in the resting position.

8. Sixth Embodiment

Figure 10:
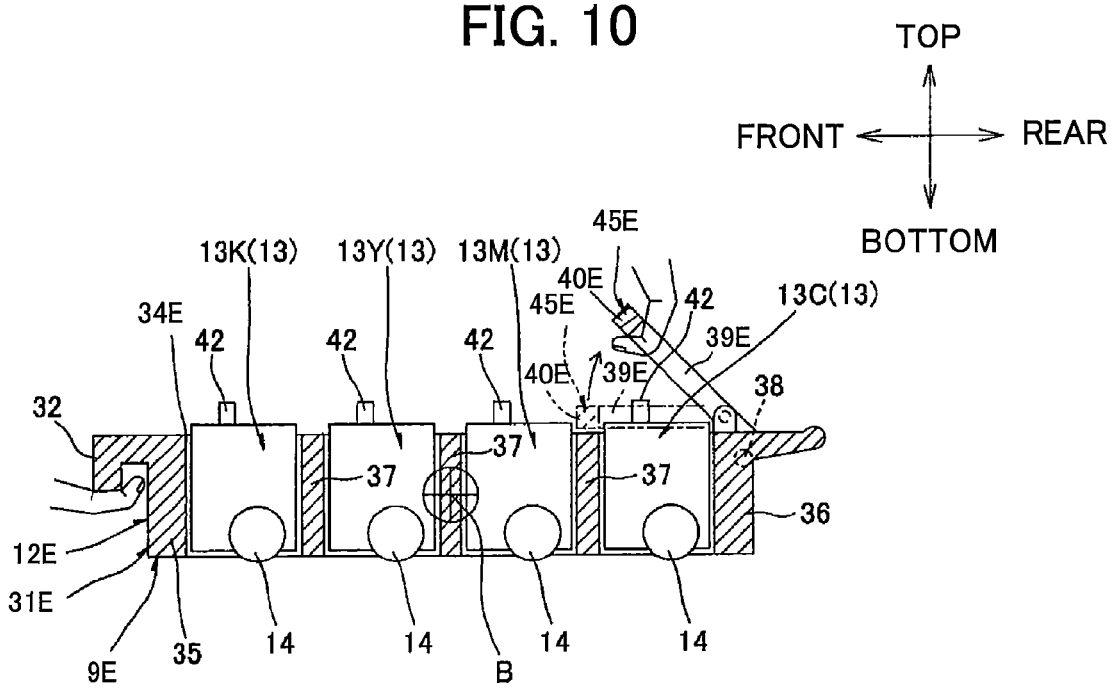
FIG. 10 is a schematic cross-sectional view for description of hand-gripping a process unit in a color printer according to a sixth embodiment of the present invention.

A sixth embodiment is shown in FIG. 10. In the fourth and fifth embodiments, a range of pivot angle is almost 90 degrees. In the sixth and seventh embodiments, the range of pivot angle is more restricted into small angle.

A process unit 9E has a drawer unit 12E including a drawer frame 31E provided with a pair of side walls 34E. Each base end portion of each leg 39E of a back side handgrip 45E is pivotally connected to a rear end portion of an upper surface of each side wall 34E and at a position rearward of the rearmost process cartridge 13C. Further, a base end face of each leg 39E is slanted with respect to a longitudinal direction of the leg 39E, such that in the base end portion, a corner angle at its rear side is smaller than a corner angle at its front side.

With this structure, if the back side handgrip 45E is moved from the resting position toward an upstanding position, the slanting base end face is in contact with the upper surface of the side wall 34E to prevent the handgrip 45E from moving further upward. In this state, the grip portion 40E is positioned spaced away from and above the rearmost process cartridge 13C. In the resting position, the grip portion 40E is positioned immediately above the rearmost partitioning wall 37 and each leg 39E is positioned on an upper surface of each side wall 34E.

Further, the connected portion i.e., the base end portion of the leg 39E is positioned rearward of the center of gravity B, while the near side handgrip 32 is positioned frontward of the center of gravity B similar to the foregoing embodiments.

9. Seventh Embodiment

Figure 11:
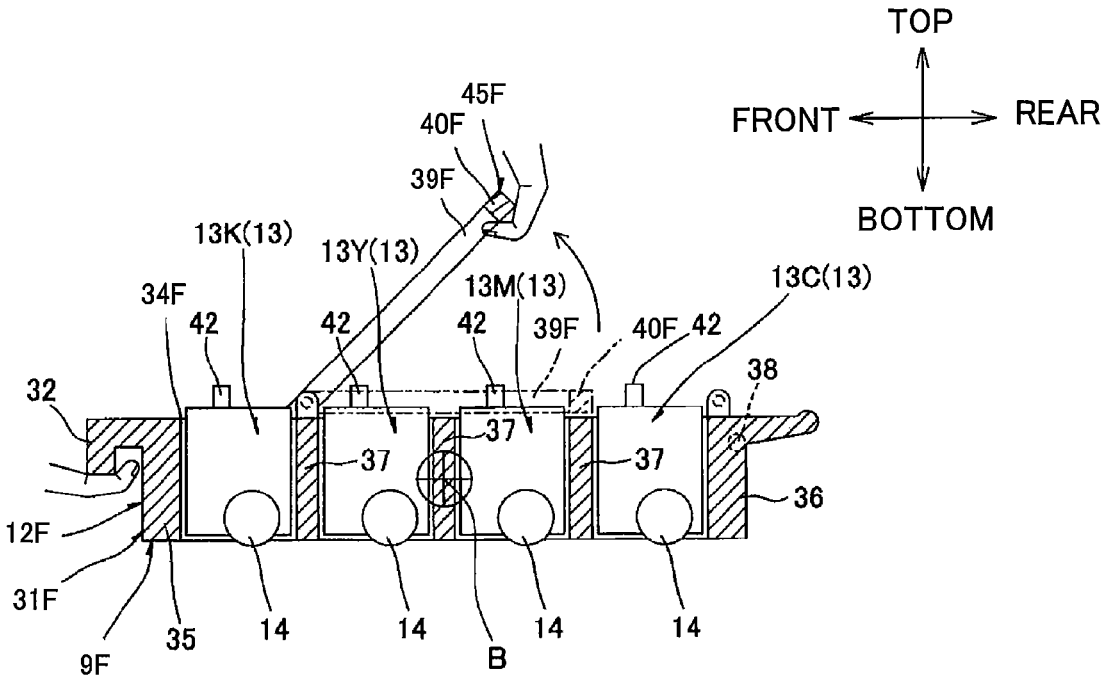
FIG. 11 is a schematic cross-sectional view for description of hand-gripping a process unit in a color printer according to a seventh embodiment of the present invention.

A seventh embodiment is shown in FIG. 11. A process unit 9F has a drawer unit 12F including a drawer frame 31F provided with a pair of side walls 34F. Each base end portion of each leg 39F of a back side handgrip 45E is pivotally connected to an upper surface of each side wall 34F at a position laterally beside the frontmost partitioning wall 37. Further, a base end face of each leg 39E is slanted with respect to a longitudinal direction of the leg 39F, such that in the base end portion, a corner angle at its front side is smaller than a corner angle at its rear side.

With this structure, if the back side handgrip 45F is moved from the resting position toward an upstanding position, the slanting base end face is in contact with the upper surface of the side wall 34F to prevent the handgrip 45F from moving further upward. In this state, the grip portion 40F is positioned spaced away from and above the magenta process cartridge 13M. In the resting position, the grip portion 40F is positioned immediately above the rearmost partitioning wall 37, and each leg 39F is positioned on an upper surface of each side wall 34F.

Further, the grip portion 40F is positioned rearward of the center of gravity B, whereas the near side handgrip 32 is positioned frontward of the center of gravity B.

10. Other Modifications

In the first embodiment, the opening 23 has a front end opening part and upper front end opening part. However, the upper front end opening part can be dispensed with as long as the front end opening can provide access to the back side handgrip at the pulled-out position of the process unit.

While the invention has been described in detail with reference to the embodiments thereof, it would be apparent to those skilled in the art that various changes and modifications may be made therein without departing from the spirit of the invention.

What is claimed is:

1. An image-forming device comprising:

a main casing; and a process unit comprising:

a plurality of cartridges arrayed side by side with a space between neighboring cartridges and defining an array direction, each of the plurality of cartridges accommodating therein a developing agent; and a support unit supporting the plurality of cartridges, the support unit movable in the array direction relative to the main casing between an accommodated position and a pulled-out position, the accommodated position comprising the support unit accommodated in the main casing, the pulled-out position comprising the support unit moved away from the accommodated position for detachment and attachment of the support unit from and to the main casing, the support unit comprising:

a frame;

a first handgrip comprising:

a leg portion comprising a connected portion connected to the frame; and a grip portion connected to the leg portion, the grip portion positioned downstream of a downstream end of a most-upstream side cartridge in a pulling-out direction along the array direction, the grip portion for pulling out the support unit in a state where the support unit is at the accommodated position; and a second handgrip positioned downstream of the first handgrip in the pulling-out direction.

2. The image-forming device of claim 1, wherein the process unit defines a position of center of gravity;

wherein the connected portion is fixed to the frame; and wherein the grip portion is positioned upstream of the position of center of gravity in the pulling-out direction, and the second handgrip is positioned downstream of the position of center of gravity in the pulling-out direction.

3. The image-forming device of claim 2, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges; and wherein the leg portion extends from a most-upstream partitioning wall in the pulling-out direction, and the grip portion is positioned above the most-upstream partitioning wall.

4. The image-forming device of claim 2, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges; and wherein the leg portion extends from a most-downstream partitioning wall in the pulling-out direction, and the grip portion is positioned above a most-upstream partitioning wall in the pulling-out direction.

5. The image-forming device of claim 1, wherein the process unit defines a position of center of gravity;

wherein the first handgrip is movable relative to the frame; and wherein the connected portion is positioned upstream of the position of center of gravity in the pulling-out direction, and the second handgrip is positioned downstream of the position of center of gravity in the pulling-out direction.

6. The image-forming device of claim 5, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges; and wherein the leg portion is protrudable from and retractable into a rearmost partitioning wall.

7. The image-forming device of claim 5, wherein the connected portion is pivotally movably connected to the frame such that the grip portion is movable between a hand-held position and a resting position.

8. The image-forming device of claim 7, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges;

wherein the connected portion is pivotally connected to the side wall at a position upstream of a most-upstream side cartridge in the pulling-out direction; and wherein the grip portion is positioned above a most-upstream partitioning wall in the pulling-out direction when the grip portion is at the resting position.

9. The image-forming device of claim 7, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges;

wherein the connected portion is pivotally connected to the side wall at a position beside a most-upstream cartridge in the pulling-out direction; and wherein the grip portion is positioned above one of the partitioning walls when the grip portion is at the resting position.

10. The image-forming device of claim 7, wherein the leg portion is maintains an inclined position relative to the frame when the grip portion is at the hand-held position.

11. The image-forming device of claim 1, wherein the process unit defines a position of center of gravity;

wherein the first handgrip is pivotally movable relative to the frame between a hand-held position and a resting position;

wherein the frame comprises a pair of side walls, a front wall, a rear wall, and a plurality of partitioning walls provided between the front wall and the rear wall and between the pair of side walls, a plurality of accommodation spaces being defined by the plurality of partitioning walls for accommodating each cartridge in each accommodation space; and wherein the first handgrip comprises:

a leg portion having a connected portion pivotally connected to the side wall at a position beside a most-downstream partitioning wall in the pulling-out direction; and a grip portion connected to the leg portion, the grip portion being positioned upstream of the position of the center of gravity in a state where the first handgrip is at the gripping position.

12. The image-forming device of claim 11, wherein the leg portion maintains an inclined position relative to the frame when the grip portion is at the hand-held position.

13. An image-forming device comprising:

a main casing; and a process unit defining a position of center of gravity, the process unit comprising:

a plurality of cartridges arrayed side by side with a space between neighboring cartridges, the plurality of cartridges defining an array direction, each of the plurality of cartridges accommodating therein a developing agent; and a support unit supporting the plurality of cartridges, the support unit movable in the array direction relative to the main casing between an accommodated position and a pulled-out position, the accommodated position comprising the support unit accommodated in the main casing, the pulled-out position comprising the support unit moved away from the accommodated position for detachment and attachment of the support unit from and to the main casing, the support unit comprising:

a frame;

a first handgrip movable relative to the frame, the first handgrip comprising:

a leg portion comprising a connected portion connected to the frame, the connected portion positioned upstream of the position of center of gravity in a pulling-out direction; and a grip portion connected to the leg portion, the grip portion positioned downstream of a downstream end of a most-upstream side cartridge in the pulling-out direction along the array direction, the grip portion for pulling out the support unit in a state where the support unit is at the accommodated position; and a second handgrip positioned downstream of the first handgrip in the pulling-out direction and downstream of the position of center of gravity in the pulling-out direction, wherein the connected portion is pivotally movably connected to the frame such that the grip portion is movable between a hand-held position and a resting position.

14. The image-forming device of claim 13, wherein the frame comprises:

a front wall;

a rear wall;

a pair of side walls; and a plurality of partitioning walls between the front wall, the rear wall, and the pair of side walls, a plurality of accommodation spaces defined by the plurality of partitioning walls for accommodating each of the plurality of cartridges;

wherein the connected portion is pivotally connected to the side wall at a position upstream of a most-upstream side cartridge in the pulling-out direction; and wherein the grip portion is positioned above a most-upstream partitioning wall in the pulling-out direction when the grip portion is at the resting position.

15. The image-forming device of claim 13, wherein the frame comprises:

a pair of side walls;

a front wall;

a rear wall; and a plurality of partitioning walls between the front wall, the rear wall, and the pair of side walls, a plurality of accommodation spaces defined by the plurality of partitioning walls for accommodating each of the plurality of cartridges;

wherein the connected portion is pivotally connected to the side wall at a position beside a most-upstream cartridge in the pulling-out direction; and wherein the grip portion is positioned above one of the partitioning walls when the grip portion is at the resting position.

16. The image-forming device of claim 13, wherein the leg portion maintains an inclined position relative to the frame when the grip portion is at the hand-held position.

17. An image-forming device comprising:

a main casing; and a process unit defining a position of center of gravity, the process unit comprising:

a plurality of cartridges arrayed side by side with a space between neighboring cartridges, the plurality of cartridges defining an array direction, each of the plurality of cartridges accommodating therein a developing agent; and a support unit supporting the plurality of cartridges, the support unit movable in the array direction relative to the main casing between an accommodated position and a pulled-out position, the accommodated position comprising the support unit accommodated in the main casing, and the pulled-out position comprising the support unit moved away from the accommodated position for detachment and attachment of the support unit from and to the main casing, the support unit comprising:

a frame comprising:

a front wall;

a rear wall;

a pair of side walls; and a plurality of partitioning walls between the front wall, the rear wall, and the pair of side walls, a plurality of accommodation spaces defined by the plurality of portioning walls for accommodating each of the plurality of cartridges;

a first handgrip pivotally movable relative to the frame between a hand-held position and a resting position, the first handgrip comprising:

a leg portion comprising a connected portion, the connected portion connected to the frame and pivotally connected to the side wall at a position beside a most-downstream partitioning wall in a pulling-out direction; and a grip portion connected to the leg portion, the grip portion positioned downstream of a downstream end of a most-upstream side cartridge in the pulling-out direction along the array direction and upstream of the position of the center of gravity in a state where the first handgrip is at a gripping position, the grip portion for pulling out the support unit in a state where the support unit is at the accommodated position; and a second handgrip positioned downstream of the first handgrip in the pulling-out direction.

18. The image-forming device of claim 17, wherein the leg portion is configured to maintain an inclined position relative to the frame when the grip portion is at the hand-held position.

* * * * *